US006648455B2

(12) United States Patent
Takagi

(10) Patent No.: US 6,648,455 B2
(45) Date of Patent: Nov. 18, 2003

(54) PIEZOELECTRIC INK-JET PRINTER HEAD AND METHOD OF FABRICATING SAME

(75) Inventor: Atsuhiro Takagi, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1 day.

(21) Appl. No.: 09/933,155

(22) Filed: Aug. 21, 2001

(65) Prior Publication Data

US 2002/0024567 A1 Feb. 28, 2002

(30) Foreign Application Priority Data

Aug. 22, 2000 (JP) ..... 2000-251426

(51) Int. Cl.[7] ..... B41J 2/045
(52) U.S. Cl. ..... 347/71; 347/72
(58) Field of Search ..... 347/72, 68, 71; 137/83

(56) References Cited

U.S. PATENT DOCUMENTS 4,680,595 A 7/1987 Cruz-Uribe et al.

6,328,434 B1 * 12/2001 Soneda et al. ..... 347/68

FOREIGN PATENT DOCUMENTS

JP A 4-341851 11/1992

OTHER PUBLICATIONS

U.S. patent application Ser. No. 09/897,394, Isono et al., filed Jul. 3, 2001.

* cited by examiner

*Primary Examiner*—Thinh Nguyen
(74) *Attorney, Agent, or Firm*—Oliff & Berridge, PLC

(57) ABSTRACT

An ink impermeable and electrically insulative adhesive sheet is pasted to the lower surface of a piezoelectric actuator, which is constructed by laminating alternately a piezoelectric sheet with individual electrodes and a piezoelectric sheet with a common electrode. Then, the piezoelectric actuator is bonded to a cavity plate by the aid of the adhesive sheet such that the individual electrodes of the piezoelectric actuator are aligned with pressure chambers of the cavity plate. In this construction, electrical insulation between the piezoelectric sheets is not damaged by ink in the pressure chambers of the cavity plate.

16 Claims, 11 Drawing Sheets

PIEZOELECTRIC INK-JET PRINTER HEAD AND METHOD OF FABRICATING SAME

BACKGROUND OF THE INVENTION

1. Field of Invention

The invention relates to the construction of a piezoelectric ink-jet printer head and a method of fabricating same.

2. Description of Related Art

An on-demand type piezoelectric ink-jet printer head is disclosed in U.S. Pat. No. 4,680,595. The disclosed head includes a nozzle plate having a plurality of nozzles, and a channel plate having chambers each associated with each of the nozzles. A diaphragm plate is bonded using an adhesive to the back of the channel plate. Transducers are secured to one side of the diaphragm plate so as to be aligned with the pressure chambers.

The diaphragm plate is made of a thin metal plate with a thickness of 25 $\mu$m or less in order to efficiently transmit the deformation of the transducers.

In order to vibrate the diaphragm plate together with the transducers, the transducers should be bonded onto the diaphragm plate. However, the diaphragm plate, which is extremely thin, makes a bonding operation difficult.

In addition, the diaphragm plate is 25 $\mu$m or less in thickness, and thus its rigidity is very low. Accordingly, when any transducer deforms to change the pressure in the pressure chamber, the diaphragm plate itself generates vibrations separately from the transducer. To eliminate the influence of such vibrations, the transducer driving cycle should be elongated. Consequently, the transducers cannot be driven at high frequencies, resulting in a prolonged ink ejection cycle and a low print speed.

An ink-jet head disclosed in Japanese Laid-Open Patent Application No. 4-341851 addresses the above problems. The disclosed head includes a nozzle plate having a plurality of nozzles, a cavity plate having pressure chambers each associated with each of the nozzles, and a plate type piezoelectric actuator. The piezoelectric actuator is constructed by laminating piezoelectric sheets, each sandwiched by flat individual electrodes formed in a one-to-one correspondence with the pressure chambers and a common electrode shared by the pressure chambers. The individual electrodes are electrically insulated from the common electrodes by each of the piezoelectric sheets. The piezoelectric sheets are laminated such that the individual electrodes are aligned with the associated pressure chambers.

In this construction, the lowermost piezoelectric sheet is bonded to the cavity plate at portions other than the pressure chambers such that the lowermost piezoelectric sheet covers the pressure chambers. The piezoelectric sheets are made of ceramic and are likely to absorb water.

Accordingly, when the ink-jet head is used for a long time, the lowermost piezoelectric sheet absorbs water content contained in the ink guided to the pressure chambers, and electrical insulation between the individual electrodes and the common electrode is damaged.

To solve such a problem, interposing a synthetic resin diaphragm plate between the lowermost piezoelectric sheet and the cavity plate is conceivable. However, because a synthetic resin diaphragm plate is far less rigid than a metal diaphragm plate, driving the ink-jet head at high frequencies becomes much more difficult.

SUMMARY OF THE INVENTION

The invention involves providing an adhesive or an adhesive sheet between the piezoelectric actuator and the cavity plate of an ink-jet printer head and a method of manufacturing an ink-jet printer head.

The ink-jet printer head has a plate type piezoelectric actuator and a metal cavity plate with pressure chambers. The piezoelectric actuator overlies the metal cavity plate and they are connected together using an adhesive sheet or simply an adhesive. The adhesive sheet covers the pressure chambers, but does not attach to the pressure chambers. It is made of an ink-impermeable resin and electrically insulative material, such as: a film of polyamide base hotmelt adhesive, a film of dimer-acid base polyamide resin, and a film of polyester base hotmelt adhesive. Instead of using an adhesive sheet, a polyolefin base hotmelt adhesive may be used.

The cavity plate includes a base plate, a nozzle plate, manifold plates and a nozzle plate. Optionally, one or more spacer plates may also be provided.

The base plate also has pressure chambers, each of the chambers has an end passage. The chambers are arranged from the base plate to form two rows so that opposed end passages of the pressure chambers are disposed in an interlaced relationship. The pressure chambers extend in a lateral direction of the base plate. Additionally, the base plate has a longitudinal central axis which defines two base plate portions, a first longitudinal reference line on one side of the longitudinal central axis, and a second longitudinal reference line on the opposite side of the longitudinal central axis. One row of the pressure chambers is disposed on one base place portion so the end passages are aligned with the longitudinal reference line on the opposite base plate portion, and the other row of pressure chambers is disposed on the other base plate portion so that the end passages of its row of chambers are aligned with the other longitudinal reference line. The base plate also includes an ink supply hole in each of the base plate portions.

The nozzle plate has a plurality of nozzles arranged in a first row and a second row in a longitudinal direction of the nozzle plate, so that the first row of nozzles is staggered from the second row of nozzles. Each nozzle corresponds to a pressure chamber end passage.

One or more manifold plates may be provided. Preferably however two manifold plates are provided. The first manifold plate is disposed between the base plate and a second manifold plate and contains a first ink passage in the shape of an elongated opening. The second manifold plate contains an ink passage having the same elongated shape as the first ink passage. However, it is recessed within the plate and does not penetrate through the plate.

The base plate, nozzle plate and manifold plate are laminated together so that each end passage of the pressure chambers is aligned with a corresponding nozzle and with the manifold plate through holes.

A spacer plate with a first and second set of apertures and a first and second spacer plate ink supply hole may be provided. The first set of apertures is disposed in the spacer plate to form a first and second row of through holes with each row being disposed in a longitudinal direction of the spacer plate. Also, the first row of through holes is staggered from the second row of through holes. The second set of apertures includes larger through holes disposed in the space plate to form rows of larger through holes.

The plates are laminated together so that ink flows through the ink supply hole into the manifold plate ink supply passages then through the rows of larger through holes and into the pressure chambers. Ink discharges through the end passages of the pressure chambers and through corresponding nozzles in the nozzle plate.

The actuator includes a first set of piezoelectric sheets and a second set of piezoelectric sheets. The first set of piezoelectric sheets has individual electrodes formed in rows, dummy common electrodes disposed thereon and through holes formed therein. The second set of piezoelectric sheets has a common electrode, lead portions formed in the common electrode, dummy individual electrodes and through holes formed therein.

The actuator includes a first sheet and a second sheet. The first sheet has sets of surface electrodes and through holes formed therein. The second sheet has individual electrodes and dummy common electrodes. The sheets are laminated together to form a stack so that the individual electrodes, the dummy electrodes and the first set of electrodes are vertically aligned and electrically connected with each other and so that the common electrodes, the dummy common electrodes and the second set of surface electrodes are vertically aligned and electrically connected. Additionally, the through holes are filled with a conductive material.

When an electrical potential is applied to the actuator, it causes the actuator to deform to increase the volume of the pressure chambers, thereby causing ink to flow into the pressure chambers. When the electrical potential is removed, the actuator returns to its original state and decreases the volume of the pressure chambers. The adhesive or adhesive sheet expands and contracts as the actuator deforms.

The method of manufacturing an ink-jet printer head involves providing a cavity plate and an actuator, applying an adhesive sheet or an adhesive to the bottom surface of the actuator, then pressing the cavity plate and actuator together. Additionally, the method includes covering the cavity plate pressure chambers with the adhesive sheet, but not attaching the adhesive sheet to the pressure chambers. The method also includes providing a base plate, a nozzle plate and a manifold fold, and laminating them together to form the cavity plate described above.

It is an object of the invention to provide an ink-jet printer head with improved overall rigidity that does not generate vibrations, so that it is easier to drive the ink-jet head at high frequencies. Additionally, it is another object of the invention to provide an adhesive sheet that expands and contracts with a piezoelectric actuator, that prevents ink leaks from developing between the piezoelectric actuator and cavity plate, and firmly secures the piezoelectric actuator to the cavity plate.

Another object of the invention is to provide a method of economically manufacturing ink-jet printer heads with reduced vibrations so that ink-jet printer heads can be driven at high frequencies.

BRIEF DESCRIPTION OF THE DRAWINGS

Preferred embodiments of the invention will be described with reference to the following figures wherein.

DETAILED DESCRIPTION OF PREFERRED EMBODIMENTS

Figure 1:
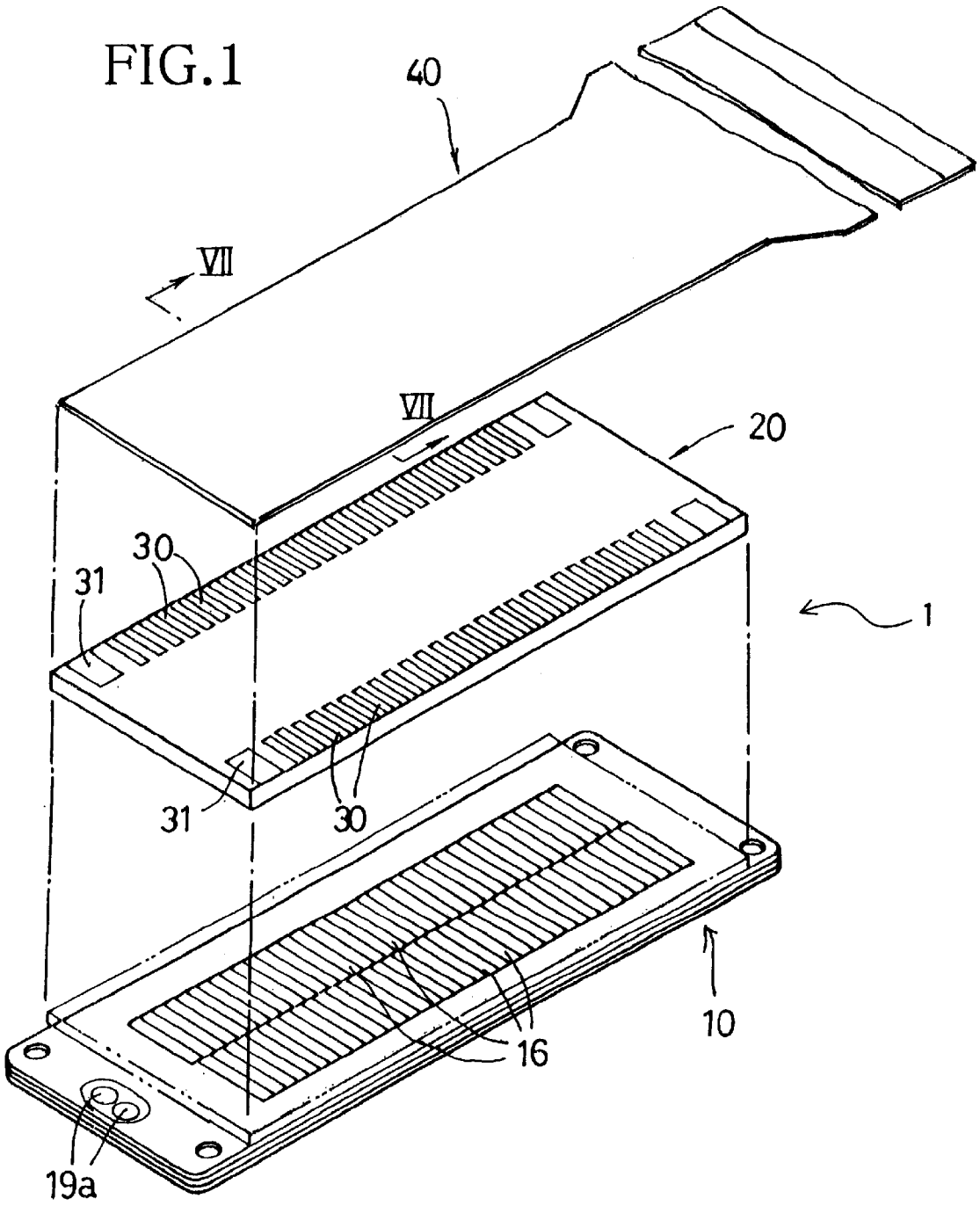
FIG. 1 is an exploded perspective view of a piezoelectric ink-jet printer head according to a first embodiment of the invention.
Figure 2:
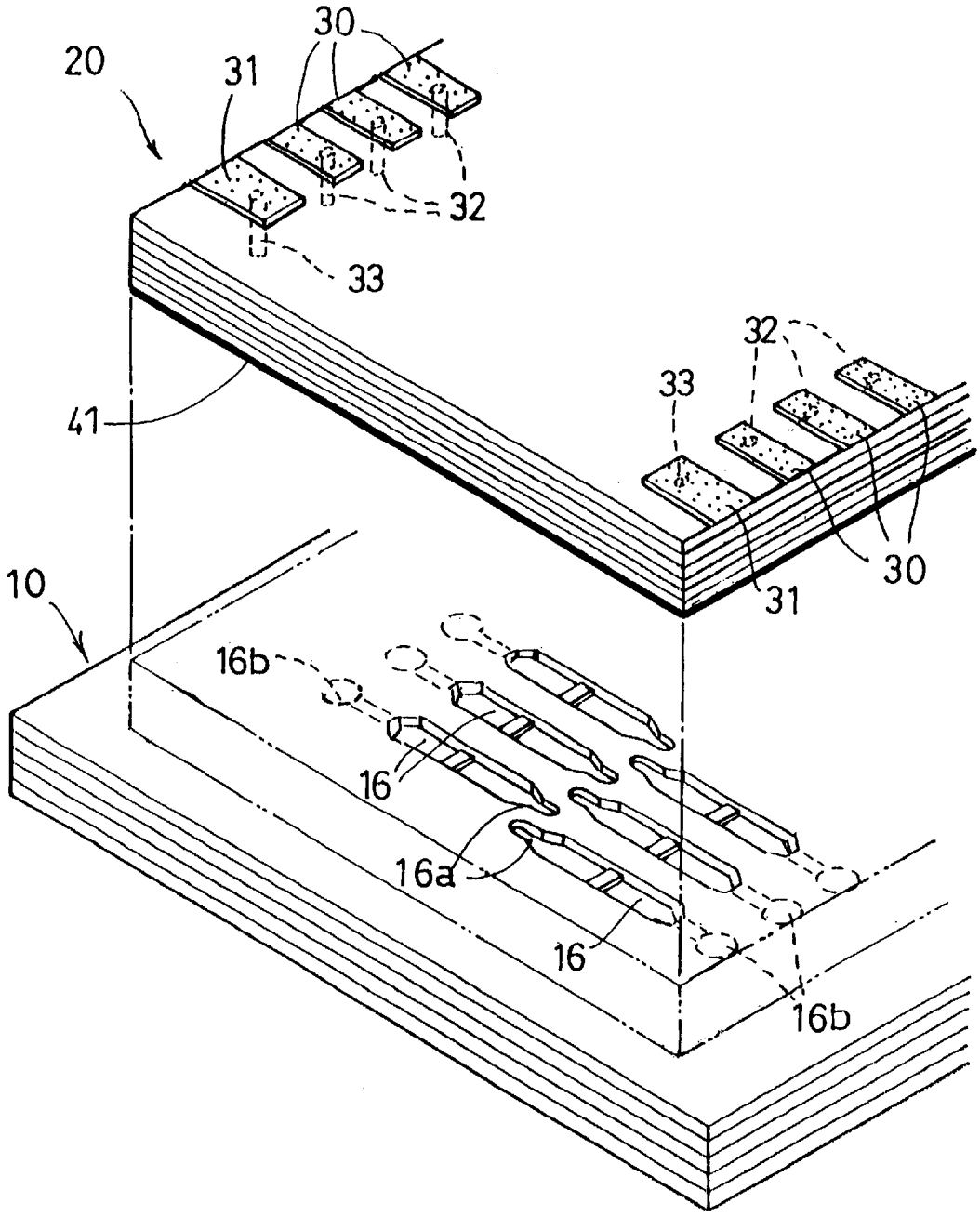
FIG. 2 is an enlarged perspective view of one end of a cavity plate and one end of a piezoelectric actuator according to the first embodiment of the invention.

U.S. patent application Ser. No. 09/897,394 is incorporated herein by reference in its entirety. Additionally, U.S. patent application Ser. No. 09/933,156 filed with the U.S. Patent and Trademark Office on the same date as the filing date of this invention, is incorporated herein by reference in its entirety.

Referring to FIGS. 1 through 8, the construction of a piezoelectric ink-jet head 1 according to a first embodiment and a method of fabricating same will be described.

A flexible flat cable 40 is bonded, using an adhesive, to the upper surface of a plate type piezoelectric actuator 20, which overlies a metal cavity plate 10, so as to establish a connection with a drive circuit of the ink-jet head 1. Ink is ejected downward from nozzles 15, shown in FIG. 3, which open toward the underside of the cavity plate 10 at the bottom.

Figure 3:
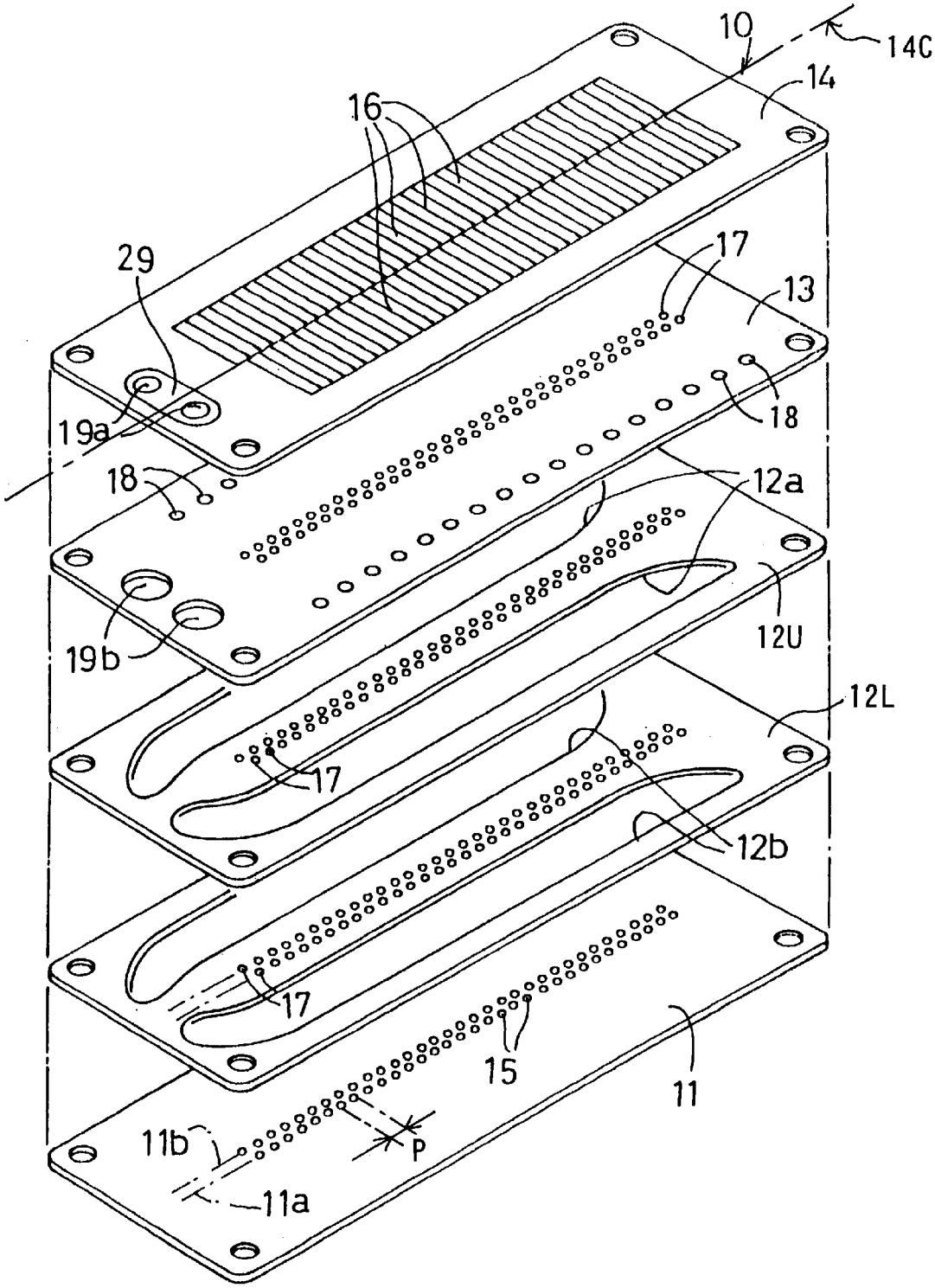
FIG. 3 is an exploded perspective view of the cavity plate.
Figure 4:
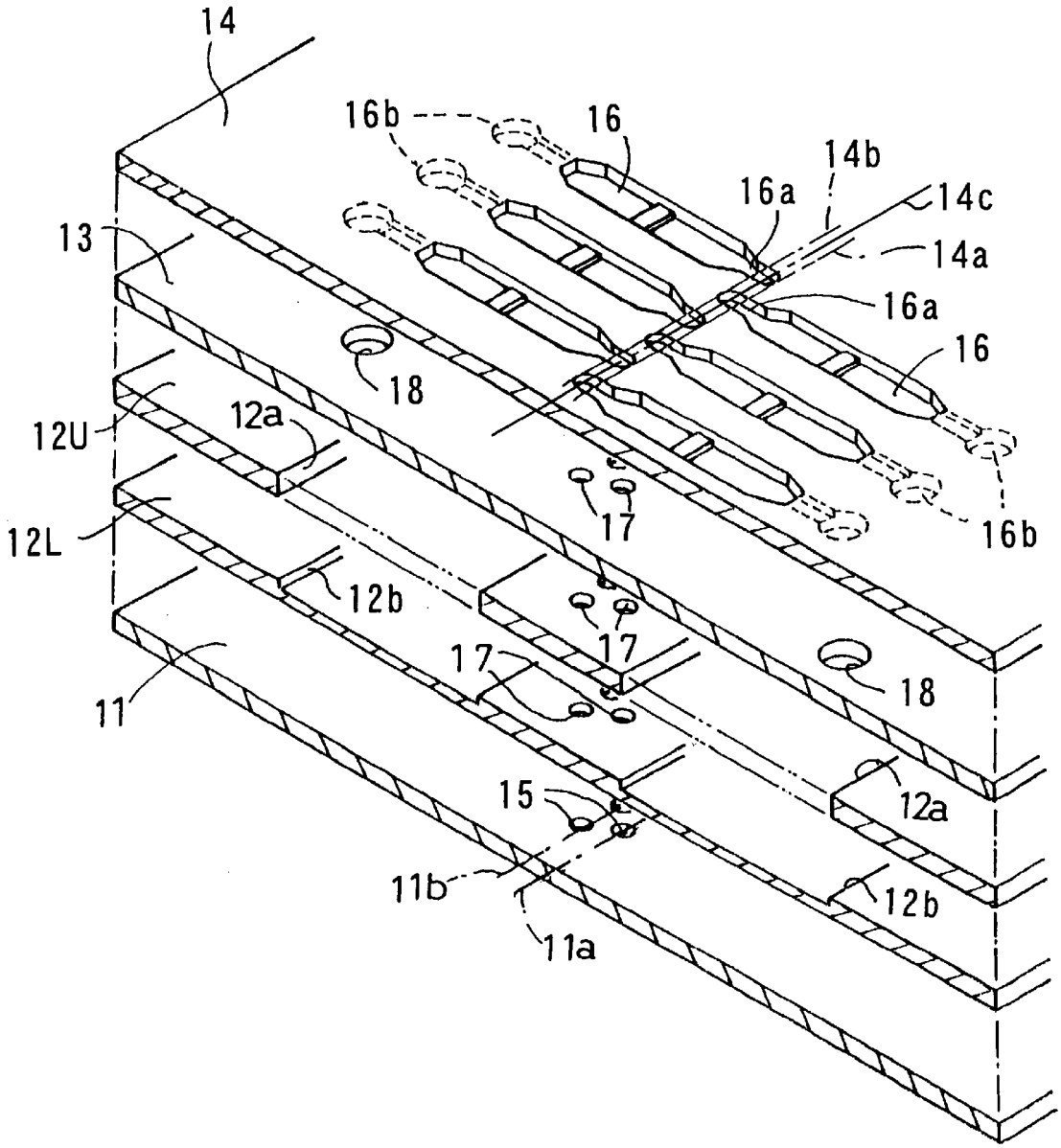
FIG. 4 is a partially enlarged perspective view of the cavity plate.

The cavity plate 10 is constructed as shown in FIGS. 3 and 4. Five thin metal plates, namely, a nozzle plate 11, manifold plates 12L, 12U, a spacer plate 13, and a base plate 14 are laminated in this order.

In the nozzle plate 11, the nozzles 15 with a very small diameter are provided for ejecting ink therefrom in two rows in a staggered configuration, along a first direction (longer side direction) of the nozzle plate 11. Specifically, a number of nozzles 15 are provided as through holes with a pitch of P, in a staggered configuration, along two reference lines 11*a*, 11*b* parallel to the first direction.

In the manifold plates 12U, 12L, ink passages 12*a*, 12*b* are provided, respectively, so as to extend along both sides of the rows of nozzles 15. As shown in FIG. 4, the ink passages 12*b* are recessed in the lower manifold plate 12L, which is contiguous to the nozzle plate 11, so as to be open only toward the upper side of the lower manifold plate 12L. The ink passages 12*a* in the upper manifold plate 12U, which overlies the lower manifold plate 12L, are formed through the manifold plate 12 into the same shape as the ink passages 12*b*.

In the manifold plates 12U, 12L, through holes 17 are formed at positions to be aligned with the nozzles 15 when the manifold plates 12U, 12L are laminated to the nozzle plate 11.

The ink passages 12*a*, 12*b* are closed by the spacer plate 13 contiguous to the upper manifold plate 12U. Likewise, through holes 17 are formed in the spacer plate 13.

In the base plate 14, a number of narrow pressure chambers 16 are provided so as to extend in the shorter side direction perpendicular to the central axis 14*c* parallel to the longer side direction. When longitudinal parallel reference lines 14*a*, 14*b* are drawn on the right and left sides of the central axis 14*c*, respectively, the ends of end passages 16*a* of the pressure chambers 16 on the right side are aligned with the left longitudinal reference line 14*b*, while the ends of end passages 16*a* of the pressure chambers 16 on the left side are aligned with the right longitudinal reference line 14*a*. The opposed end passages 16*a* of the right and left pressure chambers 16 are arranged in an interlaced relationship. Thus, the right and left pressure chambers 16 extend alternately beyond the central axis 14*c*.

The end passage 16*a* of each of the pressure chambers 16 is positioned so as to be aligned with an associated one of the nozzles 15. The end passages 16*a* communicate with the spacer plate 13 and the manifold plates 12U, 12L, via the through holes 17 having a very small diameter and formed in a staggered configuration similar to the nozzles 15.

On the other hand, the other ends 16*b* of the pressure chambers 16 communicate with the ink passages 12*a*, 12*b* in the manifold plates 12U, 12L, via the through holes 18 provided on right and left side portions of the spacer plate 13. As shown in FIG. 4, the other ends 16*b* are recessed so as to be open only toward the underside of the base plate 14.

As shown in FIG. 3, at one end of the base plate 14, supply holes 19*a* are provided so as to supply ink from an ink tank disposed above the base plate 14. A filter 29 is provided over the supply holes 19*a* so as to remove foreign matter from the ink.

At one end of the spacer plate 13, supply holes 19*b* are provided through the spacer plate 13 so as to communicate with the supply holes 19*a*. The supply holes 19*b* are positioned so as to be aligned with and communicate with end portions of the ink passages 12*a*, 12*b*.

Accordingly, ink fed from the supply holes 19*a*, 19*b* flows to the ink passages 12*a*, 12*b* and passes through each of the through holes 18, thereby to be directed to each of the pressure chambers 16. After that, the ink passes through each of the through holes 17 aligned with each of the end passages 16*a* of the pressure chambers 16 and reaches an associated one of the nozzles 15.

Figure 5:
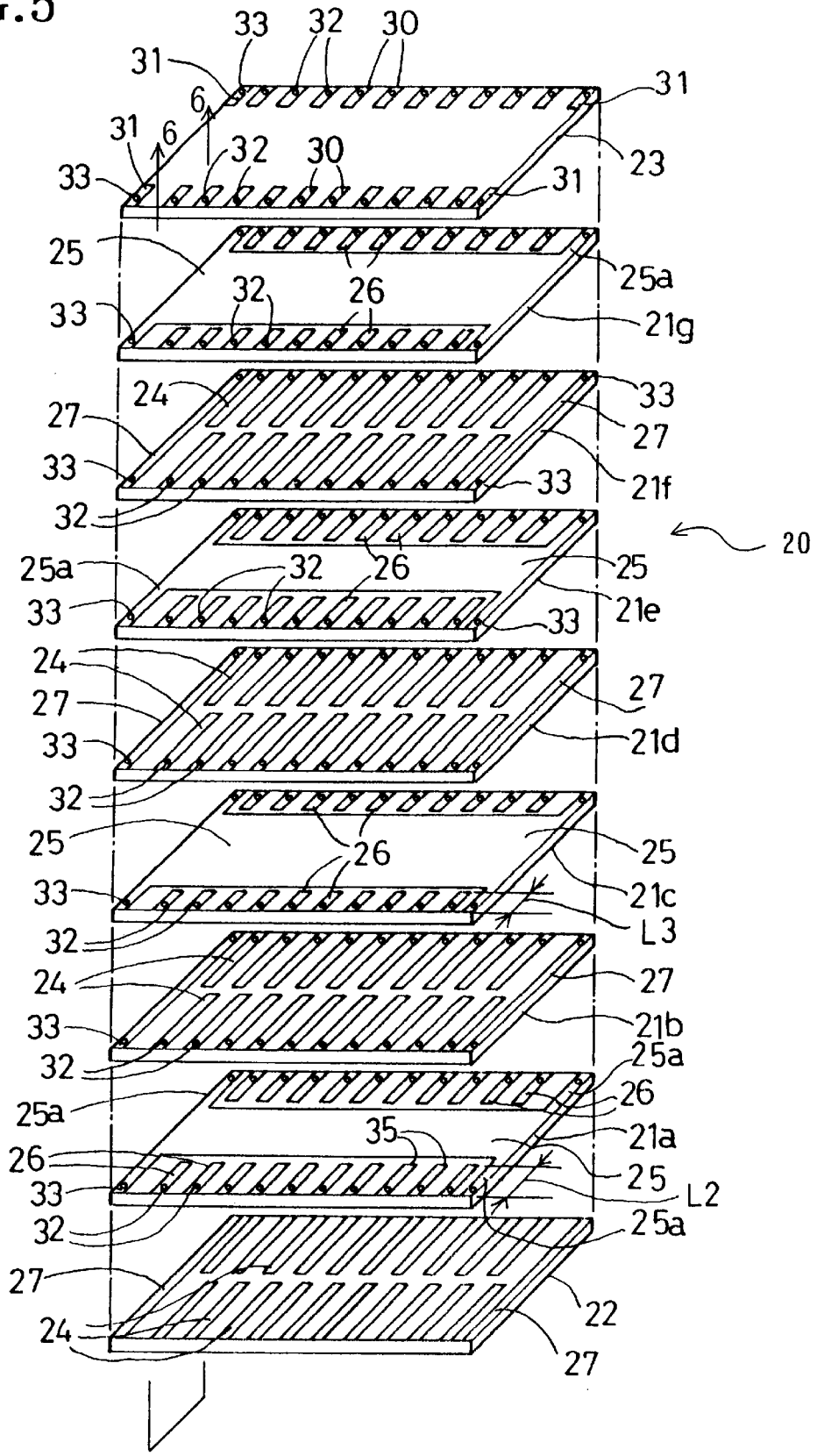
FIG. 5 is an exploded perspective view of the piezoelectric actuator.
Figure 6:
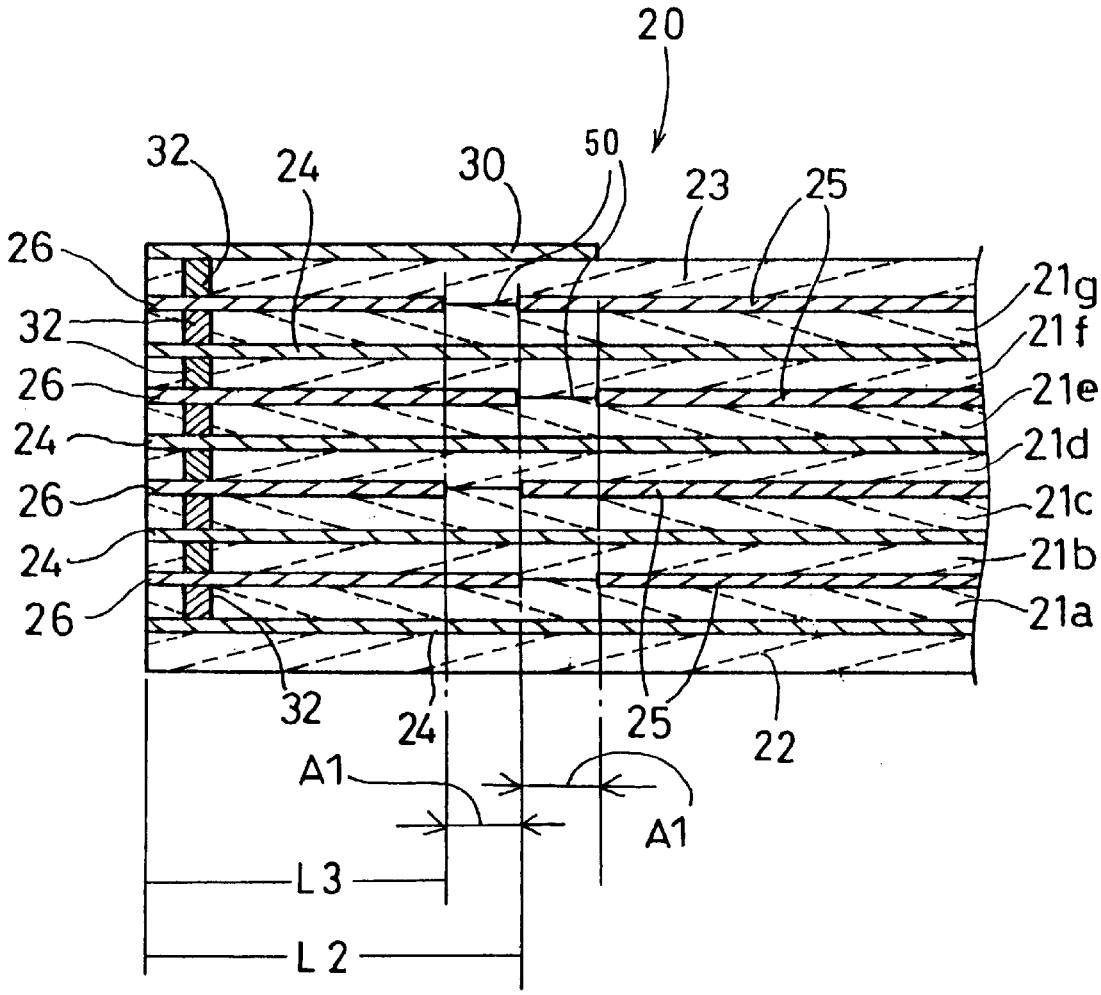
FIG. 6 is a partially enlarged side cross-sectional view of the piezoelectric actuator cut through a representative through hole such as shown by 6—6 of FIG. 5.

As shown in FIGS. 5 and 6, the piezoelectric actuator 20 is constructed by laminating nine piezoelectric sheets 21*a*, 21*b*, 21*c*, 21*d*, 21*e*, 21*f*, 21*g*, 22, 23. On the upper surface of the lowermost piezoelectric sheet 22 and on the upper side of piezoelectric sheets 21*b*, 21*d*, 21*f*, individual electrodes 24 are formed in rows along the longer side direction so as to be aligned with the respective pressure chambers 16 in the cavity plate 10. On the piezoelectric sheets 21*b*, 21*d*, 21*f*, the individual narrow electrodes 24 extend along the shorter side direction perpendicular to the longer side direction and terminate close to the longer side edges of the sheets 21*b*, 21*d*, 21*f*. On the upper surface of piezoelectric sheets 21*a*, 21*c*, 21*e*, 21*g*, a common electrode 25 is formed so as to be aligned with the pressure chambers 16.

Each of the individual electrodes 24 is designed to be slightly smaller in width than the associated pressure chamber 16.

The pressure chambers 16 are generally centered in the shorter side direction and are arranged in two rows along the longer side direction. In order to cover the two-row pressure chambers, the common electrode 25 in piezoelectric sheets 21*a*, 21*c*, 21*e*, 21*g* is formed into a rectangular shape centered in the shorter direction and extending along the longer side direction. In addition, near the shorter side edges of piezoelectric sheets 21*a*, 21*c*, 21*e*, 21*g*, lead portions 25*a* are integrally formed with the common electrode 25 so as to extend throughout the shorter side edges.

On the upper surface of piezoelectric sheets 21*a*, 21*c*, 21*e*, 21*g*, dummy individual electrodes 26 are formed at positions along the longer side edges outside the common electrode 25. The dummy individual electrodes 26 are aligned with the individual electrodes 24, and have a substantially equal width and a shorter length, compared with the individual electrodes 24.

As shown in FIGS. 5 and 6, the inner end of each of the dummy individual electrodes 26 is spaced from the longer side edge of the common electrode 25 so as to provide an appropriate clearance 50 (distance A1) therebetween. The length L2 of each of the dummy individual electrodes 26 on the second and sixth piezoelectric sheets 21*a*, 21*e* from the bottom is set to be longer, by the distance A1 of the clearance 35, than the length L3 of each of the dummy individual electrodes 26 on the fourth and eighth piezoelectric sheets 21*a*, 21*g*. Accordingly, as shown in FIG. 5, a rectangle of the common electrode 25 in the piezoelectric sheet 21*c* or 21*g* is larger, in size, than a rectangle of the common electrode 25 in the piezoelectric sheet 21*a* or 21*e*.

On the upper surface of the piezoelectric sheet 22 at the bottom and on the upper surface of piezoelectric sheets 21*b*, 21*d*, 21*f*, dummy common electrodes 27 are formed near the shorter side edges throughout their length in alignment with the contiguous lead portions 25*a*, 25*a*.

On the upper surface of the top sheet 23 at the top, surface electrodes 30 are provided along the longer side edges so as to be aligned with the respective individual electrodes 24. In addition, at the four corners of the upper surface of the top sheet 23, surface electrodes 31 are provided so as to be aligned with the lead portions 25*a* of the common electrode 25.

In the piezoelectric sheets 21*a*, 21*b*, 21*c*, 21*d*, 21*e*, 21*f*, 21*g* and the top sheet 23 through holes 32 are formed such that the surface electrodes 30 communicate with the aligned individual electrodes 24 and dummy individual electrodes 26. Similarly, through holes 33 are formed at the four corners such that the surface electrodes 31 on the top sheet 23 communicate with the aligned lead portions 25*a* of each common electrode 25, and the aligned dummy common electrodes 27.

By filling the through holes 32, 33 with a conductive material, the individual electrodes 24, the dummy individual electrodes 26, and the surface electrodes 30, which are aligned with each other in the laminating direction, are electrically connected. Likewise, the common electrodes 25, the dummy common electrodes 27, and the surface electrodes 31 on the top sheet 23, which are aligned with each other, are electrically connected.

The piezoelectric actuator 20 is fabricated by the following method.

A plurality of ceramic sheets, each of which is as large as a plurality of piezoelectric sheets 21*a*–21*g*, 22 arranged in a matrix form, should be prepared. A plurality of piezoelectric sheets are fabricated from a single ceramic sheet. The piezoelectric sheets 21*b*, 21*d*, 21*f*, 22 are fabricated in the same way because individual electrodes 24 and dummy common electrodes 27 are formed in the same positions thereon. However, the piezoelectric sheet 22 is exceptional in that no though holes 32, 33 are formed therein.

First, through holes 32, 33 are formed in three ceramic sheets, which will be the piezoelectric sheets 21*b*, 21*d*, 21*f*. No through holes need to be formed in a ceramic sheet, which will be the piezoelectric sheet 22.

Then, individual electrodes 24 and dummy common electrodes 27 are formed on the above three ceramic sheets by screen-printing using a well-known conductive paste. The conductive paste is placed at positions where the individual electrodes 24 and the dummy common electrodes 27 are formed, and is also filled into the through holes 32, 33.

Also, through holes 32, 33 are formed in four ceramic sheets, which will be the piezoelectric sheets 21*a*, 21*c*, 21*e*, 21*g*.

Then, common electrodes 25 and dummy individual electrodes 26 are formed on the above four ceramic sheets by screen-printing using a well-known conductive paste. As described above, the size of common electrodes 25 and the length of dummy individual electrodes 26 differ between the piezoelectric sheets 21*a*, 21*e* and the piezoelectric sheets 21*c*, 21*g*. Thus, the common electrodes 25 and the dummy individual electrodes 26 should be formed to satisfy the above-described relation.

Then, through holes 32, 33 are formed in a ceramic sheet corresponding to the top sheet 23. Surface electrodes 30, 31 are formed on the ceramic sheet by screen-printing using a well-known conductive paste.

The ceramic sheets obtained in this way are sufficiently dried and laminated in the order shown in FIG. 5. The laminated ceramic sheets are pressed in the laminating direction into a single laminated body. The laminated body is baked and then cut into piezoelectric actuators 20.

In each of the piezoelectric actuators 20 obtained as described above, the individual electrodes 24 and the dummy individual electrodes 26 provided on the vertically laminated piezoelectric sheets 21*a*–21*g*, 22 and the surface electrodes 30 provided on the top surface 23 are vertically aligned and electrically connected with each other, by means of the through holes 32 formed in each of the piezoelectric sheets 21*a*–21*g* and the top sheet 23. Similarly, the common electrodes 25 and the dummy common electrodes 27 provided on the piezoelectric sheets 21*a*–21*g*, 22 and the surface electrodes 31 provided on the top sheet 23 are vertically aligned and electrically connected with each other by means of the through holes 33 formed in each of the piezoelectric sheets 21*a*–21*g* and the top sheet 23.

Figure 7:
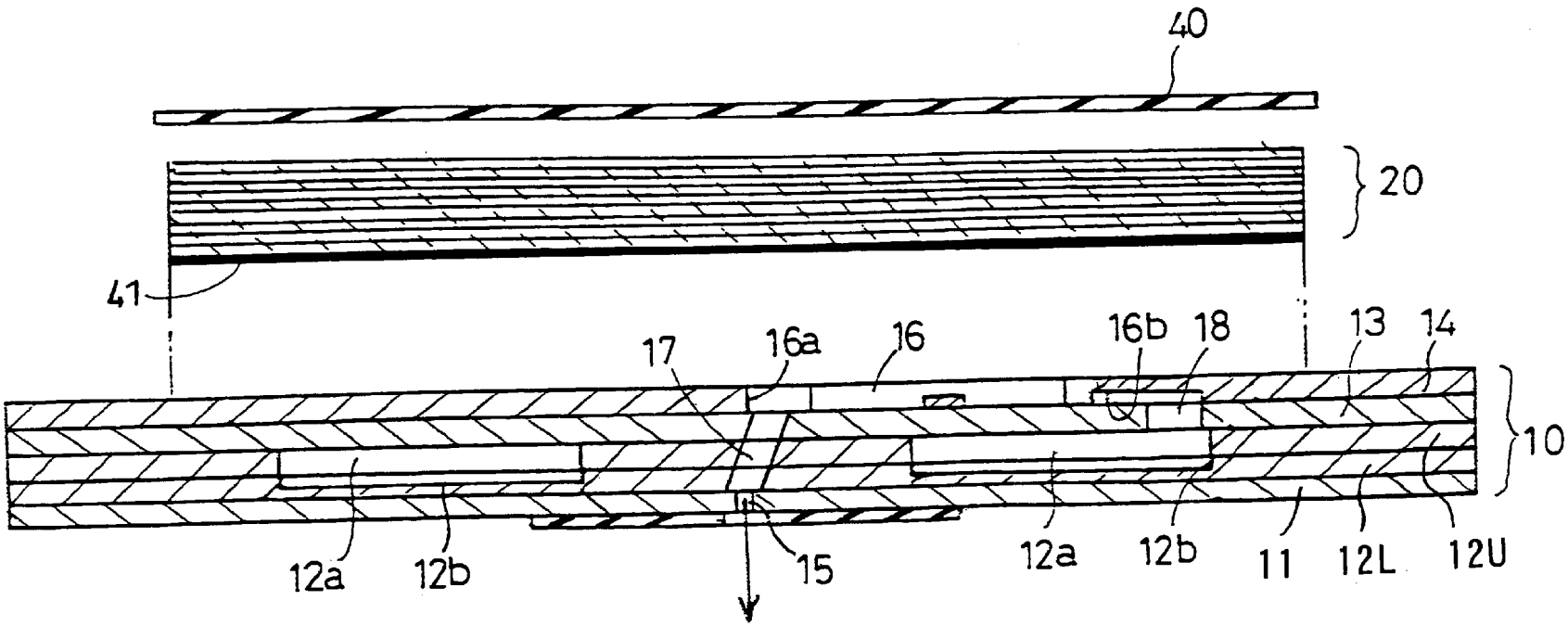
FIG. 7 is an enlarged cross-sectional view taken along line VII—VII of FIG. 1.
Figure 8:
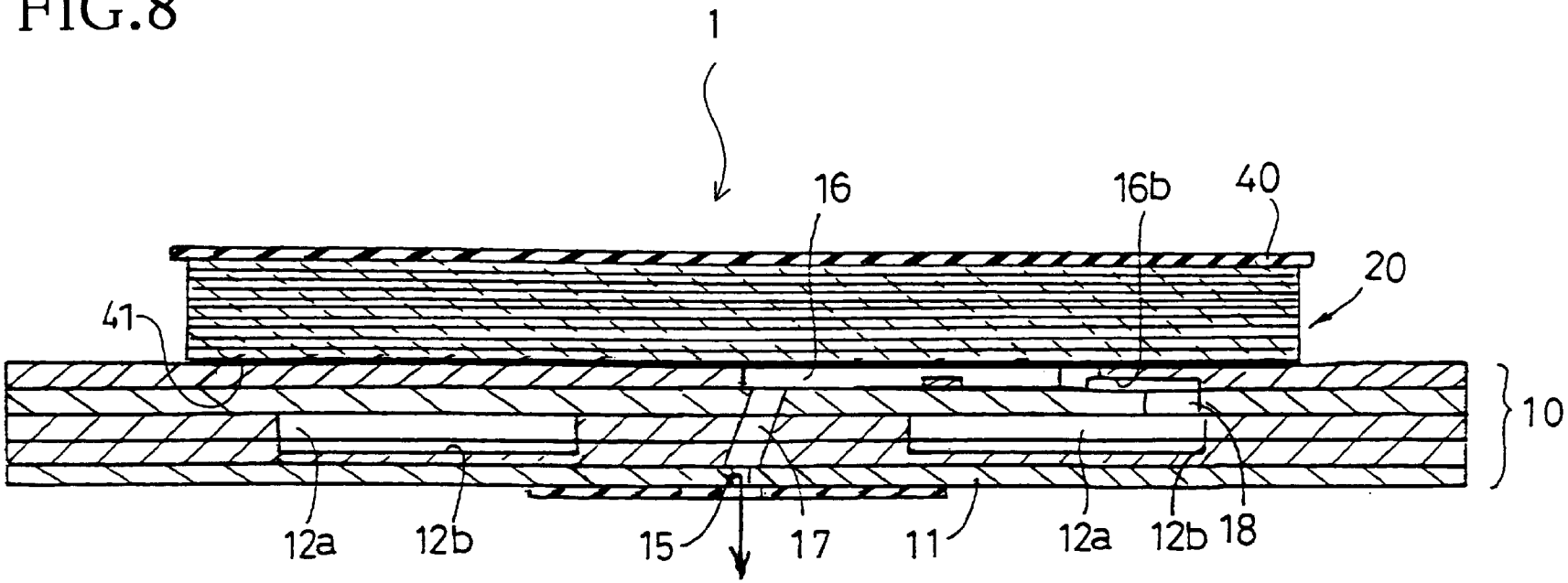
FIG. 8 is an enlarged cross-sectional view of a flexible flat cable, the cavity plate, and the piezoelectric actuator bonded to each other according to the first embodiment.

Then, as shown in FIG. 7, a single adhesive sheet 41 made of an ink-impermeable synthetic resin is bonded entirely to the lower surface of the piezoelectric actuator 20, that is, the lower surface of the piezoelectric sheet 22. Then, the piezoelectric actuator 20 is bonded to the cavity plate 10 such that the individual electrodes 24 in the piezoelectric actuator 20 are aligned with the respective pressure chambers 16. Consequently, as shown in FIG. 8, the adhesive sheet 41 is bonded to the base plate 14 of the cavity plate 10 at portions other than the pressure chambers 16, thereby securing the piezoelectric actuator 20 to the cavity plate 10.

In addition, a flexible flat cable 40 is pressed onto the upper surface of the piezoelectric actuator 20, that is, onto the upper surface of the top sheet 23, and various wiring patterns (not shown) are electrically connected to each of the surface electrodes 30, 31.

Fabrication of the ink-jet head 1 is now completed.

An ink-impermeable and electrically insulative material should be used for the adhesive sheet 41. More specifically, it is preferable to use a film of polyamide base hotmelt adhesive mainly composed of a nylon base or dimer-acid base polyamide resin, or a film of polyester base hotmelt adhesive. Alternatively, the piezoelectric sheet 22 may be bonded to the cavity plate 10 by applying first a polyolefin base hotmelt adhesive to the lower surface of the piezoelectric sheet 22. The thickness of the adhesive layer is preferably about 1 $\mu$m.

In order to eject ink from the ink-jet head 1, an electric potential is applied, through the flat cable 40, to the surface electrodes 30 associated with the nozzles from which ink is to be ejected to cause a potential difference between the surface electrodes 30 and the surface electrodes 31. This causes a potential difference between the individual electrodes 24 aligned with the above surface electrodes 30 and the common electrodes 25. Then, portions of the piezoelectric sheets 21 associated with the above individual electrodes 24 deform in the laminated direction so as to increase the volume of the associated pressure chambers 16, thereby causing ink to flow into these pressure chambers 16. The ink flows from the ink passages 12*a*, 12*b* provided in the manifold plates 12U, 12L, respectively, to store the ink supplied from the holes 19*a*, 19*b*. When the electric potential applied to the surface electrodes 30 is cancelled, the deformed piezoelectric sheets 21 restore into their original state, and the volume of the associated pressure chambers 16 is reduced. Due to the pressure applied to these pressure chambers 16 when their volume is reduced, ink is ejected from the associated nozzles 15 through the associated through holes 17.

As described above, by providing the adhesive sheet 41 between the piezoelectric actuator 20 and the cavity plate 10 so as to cover all the pressure chambers 16, the adhesive sheet 41 not only serves as a film preventing the ink from permeating to the piezoelectric actuator 20 but also firmly secures the piezoelectric actuator 20 to the cavity plate. In addition, the adhesive layer 41 can be made much thinner than a conventional diaphragm plate, and the ink-jet head 1 can be fabricated at low cost. Particularly, such effects are significantly enhanced by applying an adhesive to the lower surface of the actuator 20 instead of using the adhesive sheet 41. Use of a hotmelt adhesive can substantially reduce the process time required for the piezoelectric actuator 20 to be secured to the cavity plate 10.

In addition, the piezoelectric actuator 20 is constructed by laminating the piezoelectric sheets 21, 22 extending so as to entirely cover a plurality of pressure chambers 16. Accordingly, the piezoelectric actuator 20 with improved overall rigidity does not generate vibrations in contrast to the ink-jet heads described in the Related Art and can drive the ink-jet head 1 at high frequencies. Further, because the adhesive sheet 41 is bonded to the entire lower surface of the piezoelectric actuator 20, the piezoelectric actuator 20, when driven, expands and contracts together with the adhesive sheet 41. Thus, the piezoelectric actuator 20 ejects ink efficiently even when driven at high frequencies.

Additionally, in the piezoelectric actuator 20 according to the first embodiment, clearances 50 are provided, in a staggered manner, between the inner ends of the dummy individual electrodes 26, which extend in the shorter side direction, and the longer side edges of the common electrodes 25. Such a nonuniform arrangement of the clearances 50 reduces warpage of the piezoelectric actuator 20 occurring during baking, which is one of the fabricating processes of the piezoelectric actuator 20, as described above.

As a result, a gently curved warp with a large radius, instead of a sharply angled warp, is produced. Accordingly, when the piezoelectric actuator 20 is bonded to the cavity plate 10 using the adhesive sheet 41, the piezoelectric actuator 20 can be brought into intimate contact with the cavity plate 10 without any space left between their bonding surfaces. If such a space is left therebetween, ink leaks. In the ink-jet head 1 in this embodiment, intimate contact is ensured therebetween and ink leaks are prevented.

Further, bonding pressure applied to flatten their bonding surfaces when the piezoelectric actuator 20 is bonded to the cavity plate 10 can be reduced.

Each of the piezoelectric sheets 21 is 30 μm thick. The individual electrodes 24, the common electrodes 25, and the surface electrodes 30, 31 are approximately 5 μm thick. A conductive paste is applied to where these electrodes are formed. The above thickness settings allow the conductive paste to fill the through holes 32, 33. When the piezoelectric sheet 20 is so thick that the conductive paste does not sufficiently fill the through holes 32, 33, the conductive paste applied should be sucked from the back of the piezoelectric sheet 21 such that the though holes 32, 33 are sufficiently filled with the conductive paste.

Figure 9:
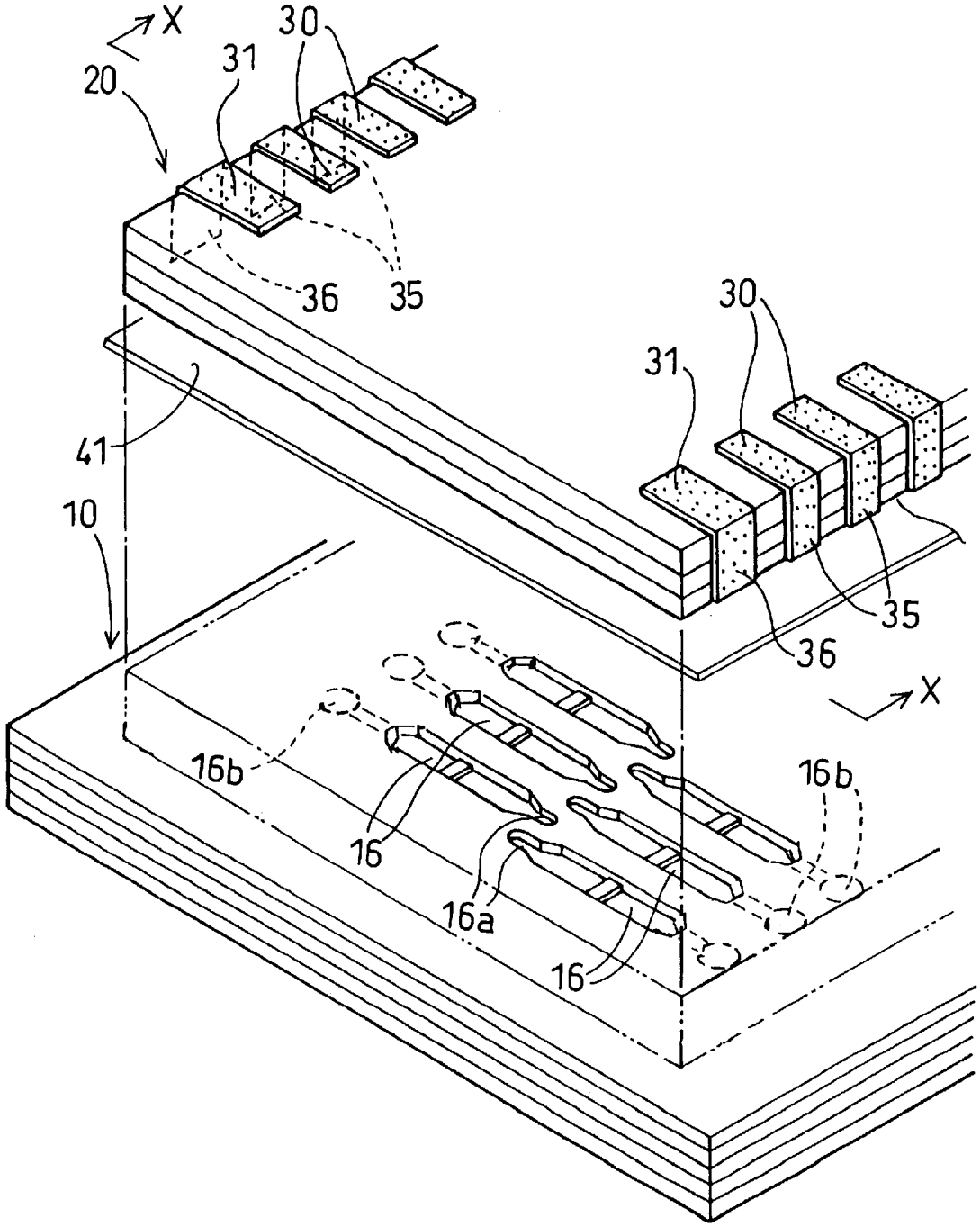
FIG. 9 is an enlarged perspective view of one end of a cavity plate and one end of a piezoelectric actuator according to a second embodiment of the invention.

FIGS. 9 though 11 show an ink-jet head 1 according to a second embodiment of the invention. In this embodiment, the same structural elements as those of the first embodiment are indicated by the same reference numerals.

In the second embodiment, side electrodes 35, 36 are formed on the sides of a piezoelectric actuator 20 continuously from surface electrodes 30, 31, respectively, instead of the through holes in the first embodiment. The side electrodes 35, 36 are formed from a conductive paste, as are individual electrodes 24, common electrodes 25, dummy individual electrodes 26, and dummy common electrodes 27. When the individual electrodes 24, common electrodes 25, dummy individual electrodes 26, and dummy common electrodes 27 are screen printed, the side electrodes 35, 36 are screen printed on the sides of each of the piezoelectric sheets 21*a*–21*g* so as to be connected to the above-described respective electrodes.

The side electrodes 35, 36 are vertically connected with each other into continuous electrodes, in the above-described pressing and baking processes, as shown in FIG. 9. As a result, the surface electrodes 30 are electrically connected, via the side electrodes 35, to the individual electrodes 24 and the dummy individual electrodes 26, while the surface electrodes 31 are electrically connected, via the side electrodes 36, to the common electrodes 25 and the dummy common electrodes 27.

Figure 10:
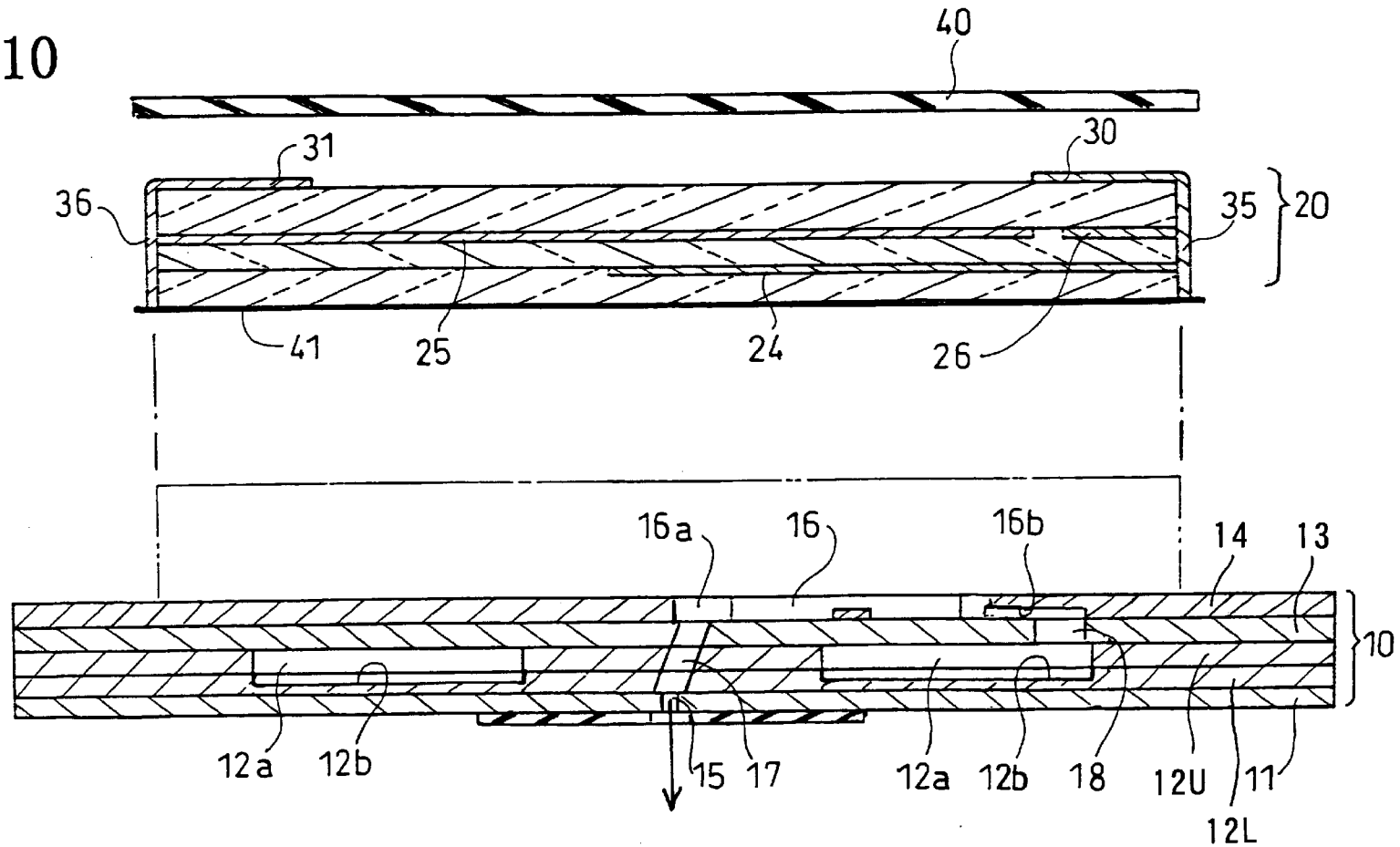
FIG. 10 is an enlarged cross-sectional view taken along line X—X of FIG. 9.
Figure 11:
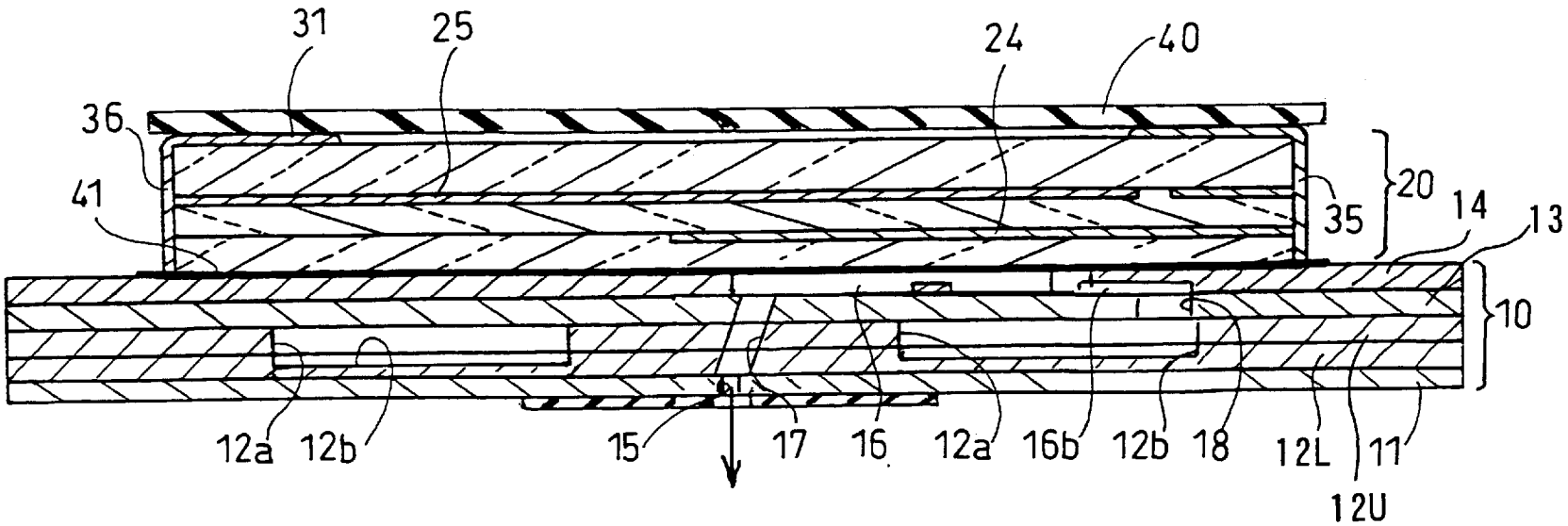
FIG. 11 is an enlarged cross-sectional view of a flexible flat cable, the cavity plate, and the piezoelectric actuator bonded to each other according to the second embodiment.

Then, as shown in FIG. 10, a single adhesive sheet 41 is bonded to the lower surface of the piezoelectric actuator 20, and the ink-jet head 1 shown in FIG. 11 is obtained. The ink-jet head 1 of this embodiment ejects ink in the same manner as in the first embodiment.

As shown in FIG. 10, in the second embodiment, the adhesive sheet 41 is slightly larger than the lower surface of the piezoelectric actuator 20 and extends therefrom. Thus, the adhesive sheet 41 separates the side electrodes 35, 36 from the upper surface of the cavity plate 10. As described above, the cavity plate 10 is composed of the nozzle plate 11, the manifold plates 12U, 12L, the spacer plate 13, and the base plate 10, all of which are made of metal. Thus, the adhesive sheet 41 electrically insulates the side electrodes 35, 36 from the cavity plate 10. Such an electrically insulated state can be obtained simply by bonding the adhesive sheet 41.

In each of the above-described embodiments, piezoelectric sheets having individual electrodes 24 and piezoelectric sheets having a common electrode 25 may be laminated in the reverse order such that a piezoelectric sheet having a common electrode 25 is disposed at the bottom of the piezoelectric actuator 20.

While the invention has been described with reference to specific embodiments, the description of the specific embodiments is illustrative only and is not to be construed as limiting the scope of the invention. Various other modifications and changes may occur to those skilled in the art without departing from the spirit and scope of the invention.

What is claimed is:

1. A fluid-ejection head, comprising:

a cavity plate having a plurality of pressure chambers;

an actuator; and an adhesive layer only disposed between the actuator and the cavity plate to firmly attach the actuator to the cavity plate, wherein the adhesive layer covers the plurality of pressure chambers.

2. A fluid-ejection head as claimed in claim 1, the adhesive being an adhesive sheet made of an ink-impermeable resin that is an electrically insulative material.

3. A fluid-ejection head as claimed in claim 2, the adhesive sheet being one of a film of polyamide base hotmelt adhesive, a film of dimer-acid base polyamide resin, or a film of polyester base hotmelt adhesive.

4. A fluid-ejection head as claimed in claim 1, wherein the adhesive is disposed on a lower surface of the actuator.

5. A fluid-ejection head as claimed in claim 1, the adhesive being a polyolefin base hotmelt adhesive.

6. A fluid ejection head as claimed in claim 1, wherein the cavity plate includes a base plate having the plurality of pressure chambers, and the adhesive attaches to the base plate at areas other than the pressure chambers.

7. A fluid-ejection head as claimed in claim 1, wherein the cavity plate includes a base plate having the plurality of pressure chambers, and the adhesive does not attach to the pressure chambers.

8. A fluid-ejection head as claimed in claim 1, the cavity plate further comprising:

a base plate having a plurality of pressure chambers each pressure chamber having an end passage, the plurality of pressure chambers being disposed to form a first row of pressure chambers and a second row of pressure chambers so that opposed end passages of the pressure chambers are disposed in an interlaced relationship;

a nozzle plate having a plurality of nozzles, each one of the plurality of nozzles corresponding to one of the plurality of pressure chamber end passages; and a manifold plate having an ink-jet passage and a plurality of through holes, wherein the base plate, the nozzle plate and the manifold plate are laminated together so that each end passage of each one of the plurality of pressure chambers is aligned with a corresponding one of the plurality of nozzles, and with a corresponding one of the plurality of through holes disposed in the manifold plate.

9. A fluid-ejection head as claimed in claim 8, wherein the plurality of nozzles are disposed in the nozzle plate to form a first row of nozzles and a second row of nozzles, each row being disposed in a longitudinal direction of the nozzle plate and the first row of nozzles being staggered from the second row of nozzles.

10. A fluid-ejection head as claimed in claim 8, the manifold plate further comprising:

a first manifold plate and a second manifold plate, the first manifold plate being disposed between the base plate and the second manifold plate;

a first ink passage disposed in the first manifold plate, the first ink passage being an elongated opening; and a second ink passage disposed in the second manifold plate, the second ink passage being a recessed area having the same shape as the elongated opening.

11. A fluid-ejection head as claimed in claim 8, wherein each one of the plurality of pressure chambers is disposed in the base plate and extends in a lateral direction of the base plate.

12. A fluid-ejection head as claimed in claim 8, wherein the base plate further comprises:

a longitudinal central axis defining a first base plate portion and a second base plate portion;

a first longitudinal reference line separate from the central axis and disposed on the first base plate portion side of the central axis; and a second longitudinal reference line separate from the central axis and disposed on an opposite side of the central axis, wherein the first row of pressure chambers is disposed in the first base plate portion so that the end passages are aligned with the second longitudinal reference line, and the second row of pressure chambers is disposed in the second base plate portion so that the end passages of the second row of chambers are aligned with the first longitudinal reference line.

13. A fluid-ejection head as claimed in claim 12, further comprising:

a spacer plate having a first set of apertures, a second set of apertures, a first spacer plate ink supply hole, and a second spacer plate ink supply hole;

the first set of apertures comprising a plurality of spacer plate through holes disposed in the spacer plate to form a first row of spacer plate through holes and a second row of spacer plate through holes, each row being disposed in a longitudinal direction of the spacer plate and the first row of spacer plate through holes being staggered from the second row of spacer plate through holes;

the second set of apertures comprising a plurality of larger through holes disposed in the spacer plate to form a plurality of larger through hole rows;

the base plate including a first ink supply hole disposed in the first base plate portion and a second ink supply hole disposed in the second base plate portion;

the manifold plate includes a first manifold plate and a second manifold plate;

the first manifold plate having a plurality of ink supply passages and a plurality of manifold plate through holes disposed to form a first row of manifold plate through holes and a second row of manifold plate through holes, each row being disposed in a longitudinal direction of the first manifold plate and the first row of manifold plate through holes being staggered from the second row of manifold plate through holes;

the second manifold plate having a plurality of ink supply passages and a plurality of second manifold plate through holes disposed to form a first row of second manifold plate through holes and a second row of second manifold plate through holes, each row being disposed in a longitudinal direction of the second manifold plate and the first row of second manifold plate through holes being staggered from the second row of second manifold plate through holes;

the spacer plate through holes being aligned with the first manifold plate through holes, the first manifold plate through holes being aligned with the second manifold plate through holes, the first manifold plate ink supply holes being aligned with the second manifold plate ink supply holes, the first ink supply hole being aligned with the first spacer plate ink supply hole, the second ink supply hole being aligned with the second spacer plate ink supply hole, the first spacer plate ink supply hole being aligned with one of the plurality of ink supply passages, and the second spacer plate ink supply hole being aligned with another one of the plurality of ink supply passages, so that ink flows from the first ink supply hole to the first spacer plate ink supply hole into a corresponding first manifold plate ink supply passage and a second manifold plate ink supply passage, through one of the plurality of larger through hole rows and into the first row of pressure chambers, and so that ink is discharged through the end passages of the first row of pressure chambers and through corresponding through holes to be ejected from the nozzle plate.

14. A fluid-ejection head as claimed in claim 1, the actuator further comprising:

a first plurality of piezoelectric sheets, each of the plurality of piezoelectric sheets having individual electrodes formed in rows, dummy common electrodes disposed thereon, and through holes formed therein;

a second plurality of piezoelectric sheets, each of the plurality of piezoelectric sheets having a common electrode, lead portions formed with the common electrode, dummy individual electrodes, and through holes formed therein;

a first piezoelectric sheet having a first set and a second set of surface electrodes and through holes formed therein; and a second piezoelectric sheet having individual electrodes and dummy common electrodes, wherein piezoelectric sheets from the first plurality of piezoelectric sheets and the second plurality of piezoelectric sheets are alternately laminated together to form a stack and the first piezoelectric sheet is laminated to one surface of the laminated stack and the second piezoelectric sheet is laminated on an opposite surface of the stack so that the individual electrodes, the dummy electrodes, and the first set of electrodes are vertically aligned and electrically connected with each other and so that the common electrodes, the dummy common electrodes and the second set of surface electrodes are vertically aligned and electrically connected.

15. A fluid-ejection head as claimed in claim 14, wherein the through holes are filled with a conductive material.

16. A fluid-ejection head as claimed in claim 1, wherein an electric potential applied to the actuator causes the actuator to deform so as to increase a volume of at least one pressure chamber from an original state, thereby causing ink to flow into the pressure chambers, the actuator returns to the original state and decreases the volume of the at least one pressure chamber when the electrical potential is removed, and the adhesive layer expands and contracts with the actuator during deformation.

* * * * *